United States Patent [19]

Grimsley

[11] 4,205,495

[45] Jun. 3, 1980

[54] ADAPTER MEANS FOR A VALVE RESEATING TOOL

[76] Inventor: Ernest E. Grimsley, 4533 Wake Forest Rd., Portsmouth, Va. 23703

[21] Appl. No.: 4,125

[22] Filed: Jan. 17, 1979

Related U.S. Application Data

[63] Continuation-in-part of Ser. No. 840,453, Oct. 7, 1977, abandoned.

[51] Int. Cl.[2] ..... B24B 19/00

[52] U.S. Cl. ..... 51/241 VS

[58] Field of Search ..... 51/241 VS, 241 R, 241 S; 90/12.5

[56] References Cited

U.S. PATENT DOCUMENTS

| | | | |
|---|---|---|---|
| 801,350 | 10/1905 | Williams | 51/241 VS |
| 1,091,918 | 3/1914 | Eynon | 51/241 VS |
| 2,460,985 | 2/1949 | Jackson | 51/241 VS |
| 2,720,736 | 10/1955 | McAfee | 51/241 VS |
| 2,842,901 | 7/1958 | Ralys | 51/166 R |

FOREIGN PATENT DOCUMENTS

| | | | |
|---|---|---|---|
| 1233623 | 5/1960 | France | 51/241 VS |

*Primary Examiner*—Nicholas P. Godici
*Assistant Examiner*—Roscoe V. Parker
*Attorney, Agent, or Firm*—Griffin, Branigan & Butler

[57] ABSTRACT

The working elements of a gate valve are removed and a tool adapter is mounted on the valve body. The tool assembly is mounted on the adapter and includes an abrasive element mounted by a swivel joint which is rotatably driven. A first shaft is mounted in a housing element and is driven by an external power source. A pulley is mounted on the first shaft and, by a toothed belt, drives a second pulley. The second pulley rotates the swivel joint. The housing element extends through openings in the adapter and a base plate, the base plate being mounted on the adapter. The housing element is adjustable vertically relative to the base plate and is mounted for pivoting movement relative thereto to permit movement of the abrasive element into contact with a valve seating surface. The adapter has a configuration which mates with a portion of the valve body. The tool assembly includes a base plate which also mates with the adapter. Once the tool assembly is on the tool adapter, only a rotational movement of the tool assembly is required to properly locate the tool relative to the seating surface.

6 Claims, 6 Drawing Figures

ADAPTER MEANS FOR A VALVE RESEATING TOOL

RELATED APPLICATIONS

This application is a continuation-in-part of my copending application Ser. No. 840,453, filed Oct. 7, 1977 now abandoned.

BACKGROUND OF THE INVENTION

This invention relates to a tool for refinishing gate valves, particularly gate valves of the type employed to control steam maintained at high pressures of 600 to 1500 psi.

Presently known tools for refinishing gate valves are quite bulky, are difficult to mount and maintain in position, and frequently require removal of the insulation on the line at each side of the valve undergoing repair to permit chains, which hold the tool in place, to securely grip the valve or line. In addition, tools of the prior art have required great care in "setting up", or positioning the tool relative to the valve seating surface to be refinished.

The present invention overcomes these problems by providing a compact tool of small weight which may be mounted on a gate valve without the use of chains, the mounting, location and use of the tool being easily accomplished by one man with only a minimum amount of time being required in properly locating the tool.

SUMMARY OF THE INVENTION

An object of the present invention is to provide an adapter means for a gate valve reseating tool of the type utilized in refinishing the opposing seating surface of a high pressure gate valve after the operating components of the valve have been removed from the body thereof, the valve body having a top portion of generally circular configuration, the adapter means comprising an adapter member for mounting on the top portion of the valve body, the adapter member being configured to closely engage at least one surface of the top portion to positively locate the adapter means relative to the valve body and prevent translational movement between the adapter member and the top portion of the valve body in a predetermined plane during operation of the tool, the adapter member having a generally planar top surface with a recess therein, and an opening extending from the bottom of the recess to the bottom extent of the adapter member through which the reseating tool extends, said predetermined plane being parallel to said top surface, the recess being generally circular in shape and having a peripheral wall concentrically located with respect to the generally circular top portion of the valve body, a base plate having an opening therein, the base plate being generally circular in shape so as to be snugly received in the recess while permitting manual rotational movement of the base plate relative to the adapter member, means mounted on the base plate for pivotally supporting the tool about an axis extending parallel to the base plate with the tool extending through the opening into the valve body, and means for clamping the base plate to the adapter member in the recess to prevent relative rotational movement after said manual rotational positioning has been completed, to hold the base plate fixed during operation of the tool.

The adapter member may be internally threaded to engage external threads on the top portion of the valve body. Alternatively, the adapter means may be externally threaded to engage with internal threads on the top portion of the valve body.

In a further embodiment suitable for use with valves having a lip rather than threads around the top portion of the valve body, the adapter member is provided with a downwardly depending circular leg which is snugly received into the opening in the top portion of the valve body, and the adapter member is provided with a plurality of threaded openings through which screws may be inserted to press against the lip and hold the adapter member in place.

Other objects of the invention and its mode of operation will become apparent upon consideration of the following description and the accompanying drawing.

DETAILED DESCRIPTION OF THE INVENTION

Figure 1:
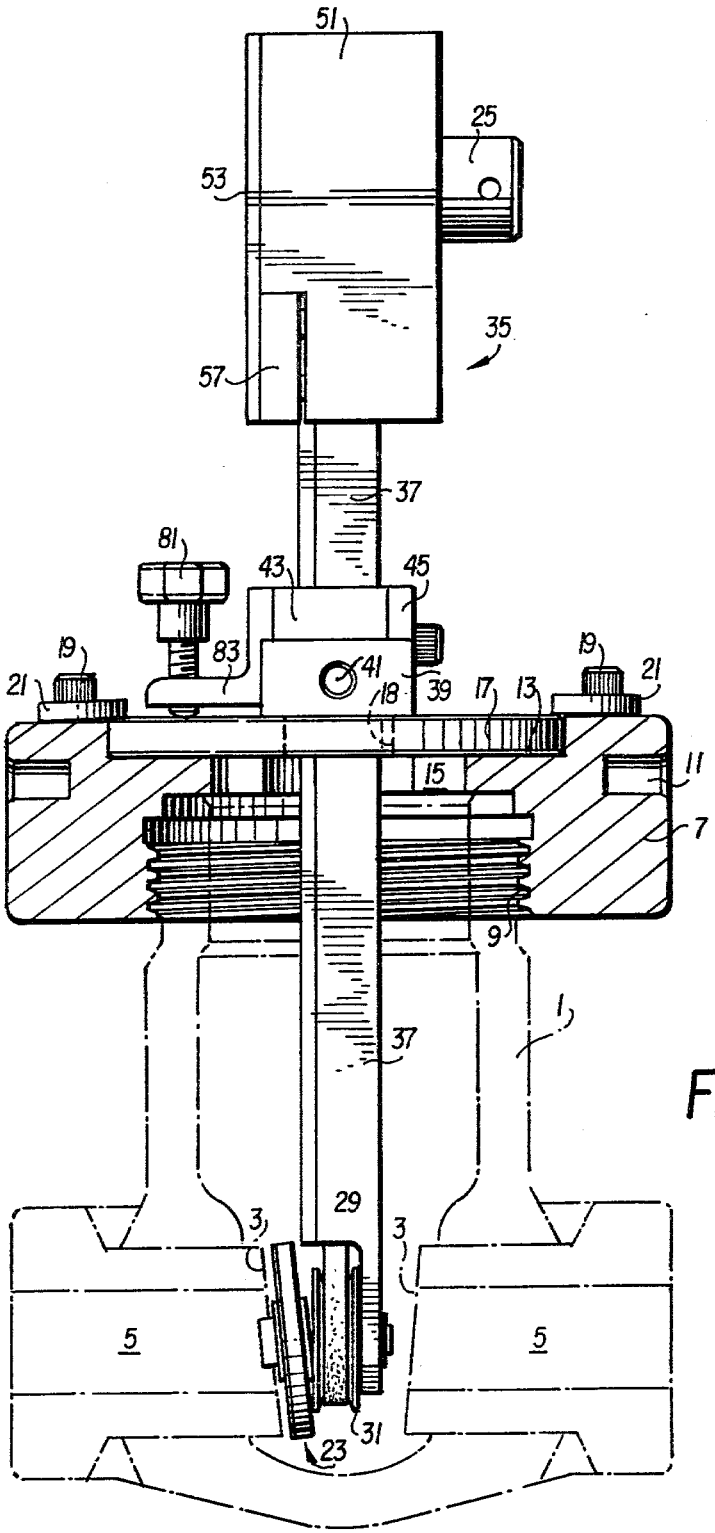
FIG. 1 is a front view, partly in section, showing a gate valve refinishing tool mounted on a gate valve and ready for use.

FIG. 1 shows a preferred embodiment of the present invention mounted on a high pressure gate valve and ready for use. The gate valve 1 (shown in phantom outline) has two annular seating surfaces 3 which frequently require refinishing because of corrosion or wear. It will be understood that the valve operating mechanisms have been removed from valve 1 before the tool is mounted thereon, these operating mechanisms including a wedge-shaped element which moves vertically to seat itself against the surfaces 3 thereby blocking flow through inlet and outlet openings 5.

Figure 3:
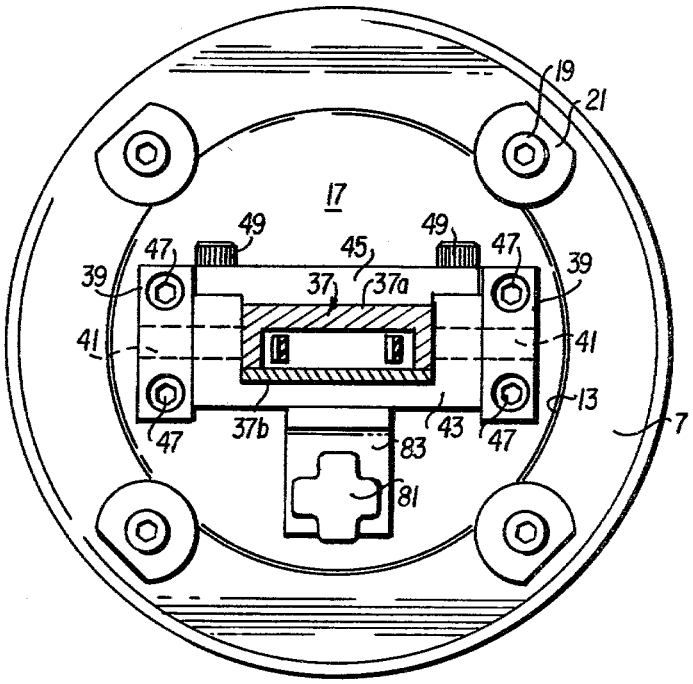
FIG. 3 is a sectional view taken along the line 3—3 of FIG. 2.

The particular valve body shown is part of a Walworth valve and typically the inlet and outlet openings may be one to two-and-one-half inches in diameter. The top portion of this type of valve body is normally generally circular and externally threaded, hence, the tool is provided with an adapter member 7 having internal threads 9 for mating with the threads on the valve body. The adapter member 7 is perferably made of aluminum and is generally circular in shape (FIG. 3). One or more recesses 11 are provided in the peripheral surface of adapter member 7 for receiving a pin or other tool utilized in tightening the adapter member onto the top of the valve body. The top surface of adapter member 7 is generally planar but is provided with a circular recess 13. A circular opening 15 extends from recess 13 to the bottom surface of adapter member 7, the lower portion of opening 15 being of larger diameter and provided with the internal threads 9. It will be understood that when adapter member 7 is positioned on the valve body, ready for use, the centers of circular recess 13 and opening 15 will be concentrically located with respect to the vertical axis of the valve body 1.

A circular base plate 17 snugly fits within the recess 13. The base plate is somewhat thicker than the recess 13 so that the base plate may be clamped in position by a plurality of screws 19 and a plurality of retainer elements 21. Since recess 13 and base plate 17 are both circular, screws 19 may be loosened to permit rotation of the base plate 17 to accomplish tool alignment as subsequently described. Base plate 17 is provided with a rectangular shaped opening 18, the length of which is no greater than the diameter of the opening 15 where it intersects recess 13.

An abrasive means 23 is provided for grinding or refinishing the valve seating surfaces 3. The abrasive means 23 preferably comprises a pressure plate or disc **23*a* (FIG. 5) having a sheet of abrasive material 23*b*** glued or otherwise affixed to one surface thereof.

Figure 5:
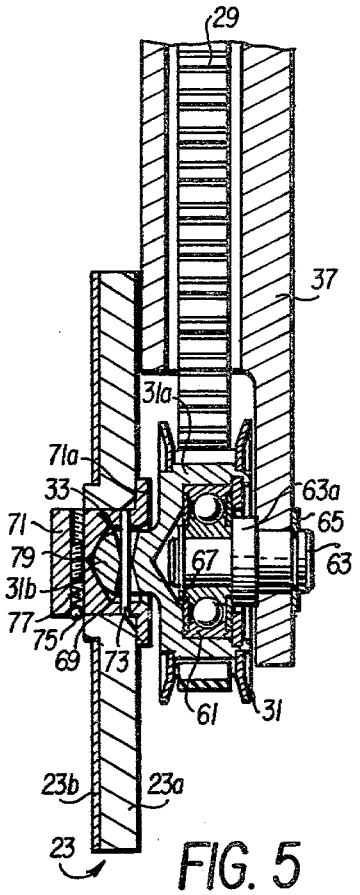
FIG. 5 is a sectional view showing an abrasive element swivelly connected to a driven pulley; and, FIG. 6 is a part sectional view of an alternative embodiment of the invention.

Abrasive means 23 is rotated by a drive means which includes an input drive shaft 25, a first pulley 27 (FIG. 4), a belt 29, a second pulley 31 (FIG. 5) and a swivel joint indicated generally at 33 in FIG. 5. The abrasive means 23 as well as belt 29 and first and second pulleys 27 and 31 are all pivotally supported on base plate 17 by a housing and support means which includes an upper housing 35, an elongated support arm 37, first and second support blocks 39, first and second pivot pins 41 and a clamping means including first and second clamping elements 43 and 45.

The support blocks 39 are secured to the upper surface of base plate 17 by a plurality of screws 47. Support blocks 39 are provided with holes for receiving the pivot pins 41. The first clamping element 43 is a U-shaped element and the arms of this element are provided with holes for receiving the pins 41. The second clamping element is a T-shaped element which is attached to the element 43 by screws 49. The elongated arm 37 extends between the legs of U-shaped element 43 and, when screws 49 are tightened, the arm 37 is clamped between elements 43 and 45. This clamping arrangement permits the user to vertically adjust the arm 37 thereby permitting adjustment of the location of the abraiding means 23 depending upon the size and type of valve being refinished. Set screws 46 (FIG. 2) lock the pivot pins 41.

The elongated support arm 37 is a box-like member as illustrated in cross-section in FIG. 3. It may, for example, be constructed by welding a U-shaped channel **37*a* to a flat plate 37*b*. The upper and lower ends of support arm 37 are open and, as illustrated in FIG. 1, one side of the arm is extended to provide a support for the pulley 31**.

Figure 4:
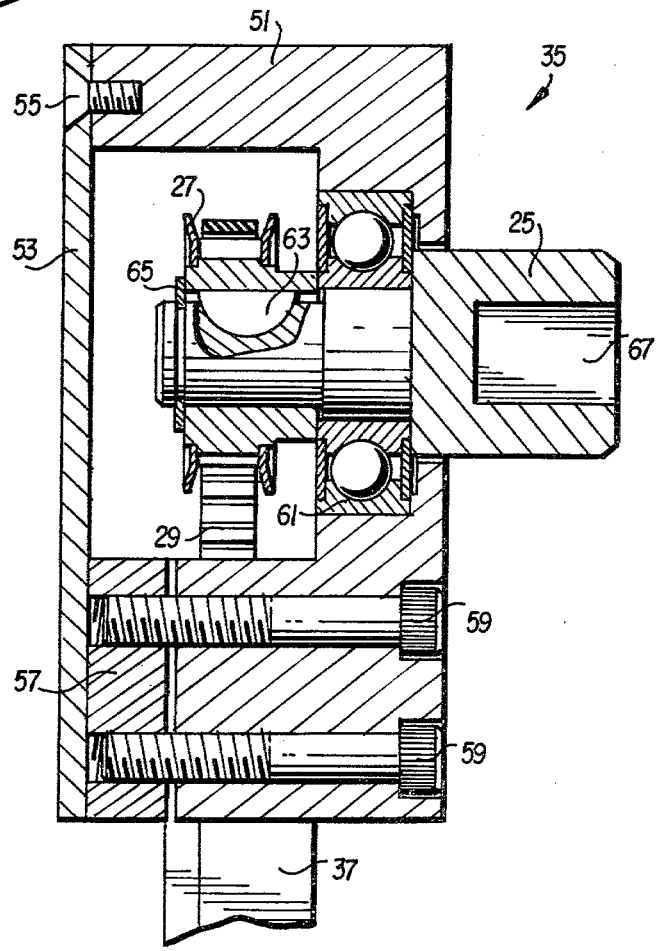
FIG. 4 is a sectional view of the upper portion of the tool housing showing the input drive shaft and drive pulley.

As illustrated in FIG. 4, the upper housing 35 comprises a substantially solid body 51 having a recess for receiving the first pulley 27. A cover plate 53 is attached by screws 55 to the body 51. A block 57 is attached by screws or other means to the cover plate 53. Screws 59 extend through element 51 and into block 57. An opening is provided in the bottom of body 51 and the upper portion of support arm 37 extends into this opening. When screws 59 are tightened, the upper portion of arm 37 is clamped between body 51 and the block 57. This arrangement permits adjustment of the tension on belt 29 by permitting movement of the upper housing 35 relative to support arm 37.

The input drive shaft 25 is mounted in a ball bearing 61 and the ball bearing is, in turn, mounted in the body 51. The first pulley 27 is mounted on shaft 25 and is keyed thereto by a Woodruff key 63. A retaining ring 65 holds the pulley 27 on shaft 25.

The portion of shaft 25 extending outside of housing 35 is provided with a square recess 67, or is otherwise adapted to receive a drive shaft of a source of rotary drive power (not shown). As input shaft 25 is rotated, it rotates pulley 27 thereby driving belt 29. The belt extends downwardly through the interior of support arm 37 and around the second pulley 31. Preferably, pulleys 27 and 31 and belt 29 are all provided with teeth in order to minimize slippage.

Referring to FIG. 5, the pulley 31 has a hub portion **31*a* which is mounted on a ball bearing 61. Bearing 61 is mounted on a stub shaft 63 which extends through, and is supported by, the lower extension of support arm 37. Shaft 63 has a portion 63*a* of enlarged diameter which serves to space the bearing 61 from the arm 37. The shaft 63 is retained on arm 37 by a C-clip or retainer ring 65. A further C-clip 67 is provided to retain the bearing 61 on shaft 63**.

The hub portion **31*a* of pulley 31 has a laterally extending portion 31*b* which forms a short swivel shaft coaxial with shaft 63. The swivel shaft 31*b* is rounded on its end. The swivel shaft is provided with a hole 69 extending therethrough near the rounded end portion. The hole 69 is larger at the outer surface of swivel shaft 31*b* than it is at the center or axis of rotation of the shaft. A pivot block 71 is recessed on one side thereof and a pivot pin 73 extends through pivot block 71 and the hole 69** thus forming a swivel joint.

A small detent element 75 is retained within the block 71 but extends slightly above the surface thereof. The detent element is spring-loaded by a spring 77 which is retained in place by a small set screw 79.

Figure 2:
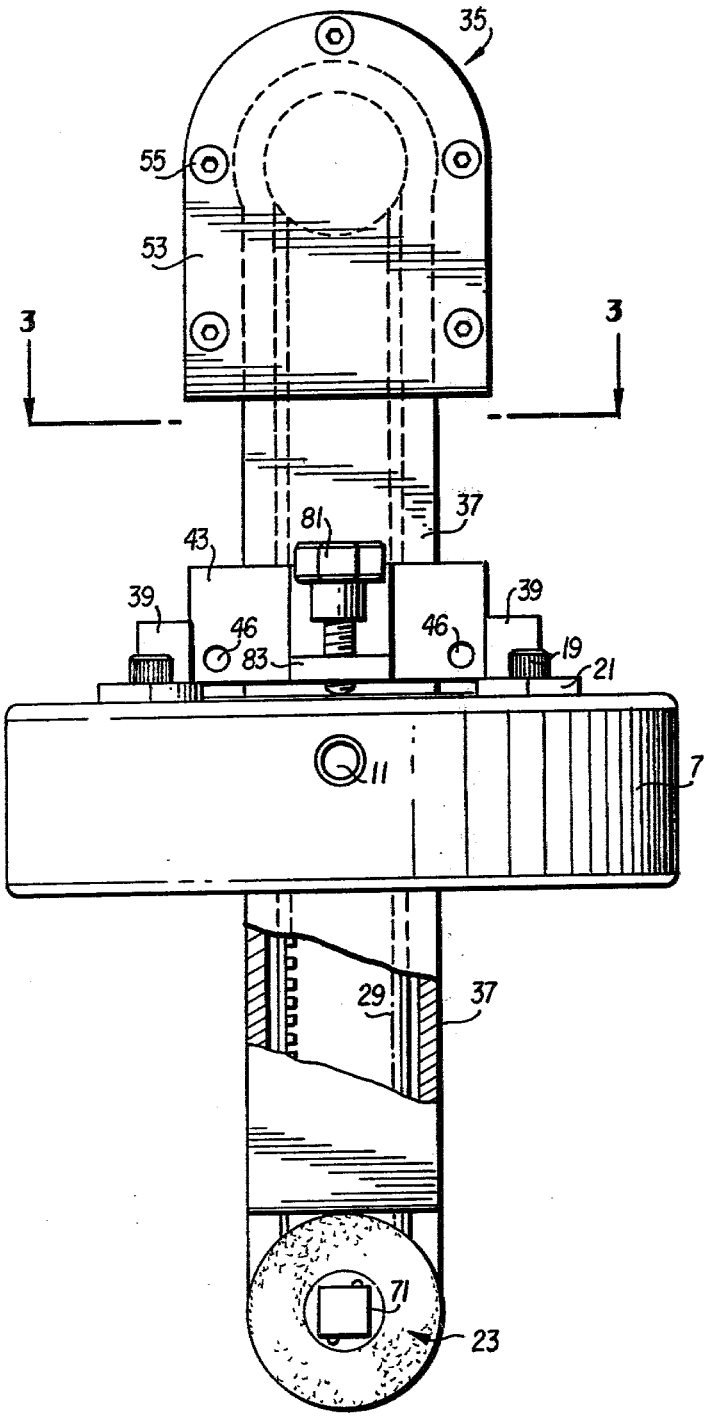
FIG. 2 is a side view, partly in section, of a gate valve refinishing tool constructed in accordance with the principles of the present invention.

As best illustrated in FIG. 2, pivot block 71 is generally square in cross-section. Pressure disc **23*a* is provided with a centrally located square opening so that the pressure disc may be inserted over the pivot block 71. The pressure disc is pressed onto the block 71 until the disc abuts radially extending portions 71*a* of the pivot block. At this point, the retaining element 75 will extend above the surface of block 71 thereby retaining the pressure disc snugly on the block. The swivel joint permits the pressure disc 23*a* carrying the abrasive surface 23*b* to align itself with a surface 3** as the disc is brought into contact with the surface.

The tool is utilized as follows. First, the bonnet and valve operating mechanisms are removed and adapter member 7 is screwed onto the top of the valve being refinished. A pressure disc **23*a* corresponding to the size of the valve being refinished is inserted on the pivot block 71. An abraiding disc corresponding to the size of the valve being refinished is glued to the pressure disc. The desired vertical position of the abraiding means 23 is then determined either by direct measurement or from data relating to the valve dimensions. The support arm 37 is then adjusted relative to base plate 17 so that when the tool assembly is placed on the adapter 7 the abraiding means 23 will be in proper position. This adjustment is accomplished by loosening screws 49, sliding support arm 37 relative to base plate 17 until it is at the desired position, and then clamping the arm 37 by tightening the screws 49. The tool assembly, comprising all parts of the tool except the adapter member 7, is now ready for positioning on the valve. The abraiding means 23 and the arm 37 are extended downwardly through opening 15 in the adapter member 7 until the base plate 17 rests firmly within the recess 13. The tool assembly is then rotated relative to the adapter member 7 and the valve until the axis of pivot pins 41** is perpendicular to the axis of the valve inlet and outlet openings 5. Stated differently, the rotational positioning of the tool assembly is such as to insure that when arm 37 is pivoted about pivot 41, it will travel in a plane which is perpendicular to the plane of the valve seating surface being refinished. Once the tool assembly is rotationally positioned, retainer elements 21 are brought into position and the base plate is clamped to the adapter member 7 by the screws 19. The source of rotary drive power (not shown) is then applied to input drive shaft 25 to thereby drive belt 29 and rotate the abrasive means 23. As rotation of the abrasive means continues, the support assembly including support arm 37 is pivoted about pivots 41. This may be accomplished by applying pressure with the hand to the cover plate 53 to move the upper housing 35 to the right as viewed in FIG. 1. Alternatively, the pivoting motion may be accomplished by turning a knob 81. This knob has a threaded shaft extending through an arm of a bracket 83. The bracket 83 is welded or otherwise affixed to clamping element 43. As hand-wheel 81 is turned to screw it into the bracket 43, the end of the knob shaft presses against base plate 17 thereby pivoting the housing and support means in a clockwise direction.

As the housing and support means including arm 37 is pivoted in the clockwise direction, the abrasive means 23 contacts the surface 3 being refinished. Because of the swivel connection previously described, the abrasive means 23 automatically aligns itself with the plane of the surface being refinished.

After a certain amount of grinding has taken place, the source of rotary drive power is turned off and the screws 19 loosened so that the tool assembly including base plate 17 may be removed for inspection of the work. If further grinding of the same surface 3 is required, the tool may be replaced as before. Once one of the surfaces 3 has been completely refinished, screws 19 are loosened and the tool assembly comprising all parts except the adapter member 7 are rotated 180°. The tool is then clamped in this new position and is ready for use in refinishing the other surface 3.

From the foregoing description it is seen that the present invention provides a tool that is easily mounted on the valve, and is easily utilized once it is mounted. Because of the construction of the adapter member 7 and base plate 17, the user does not have to make translational adjustments of the tool in a plane parallel to the top surface of the valve. The only adjustment required is a rotational adjustment which is accomplished after base plate 17 is in position and the weight of the tool is entirely on the base plate.

Furthermore the tool is readily adjustable to refinish valves of different sizes and valves made by different manufacturers. Pressure discs 23*a* and abrasive elements 23*b* may be provided in different sizes for refinishing different sized valves. The clamping elements 43 and 45 permit vertical adjustment of the tool for handling the refinishing of differently sized valves. It should be further understood that although the valve shown has external threads on its upper portion, some valves may be provided with internal threads. In this case, the tool may be provided with an adapter member 7 having external threads.

Figure 6:
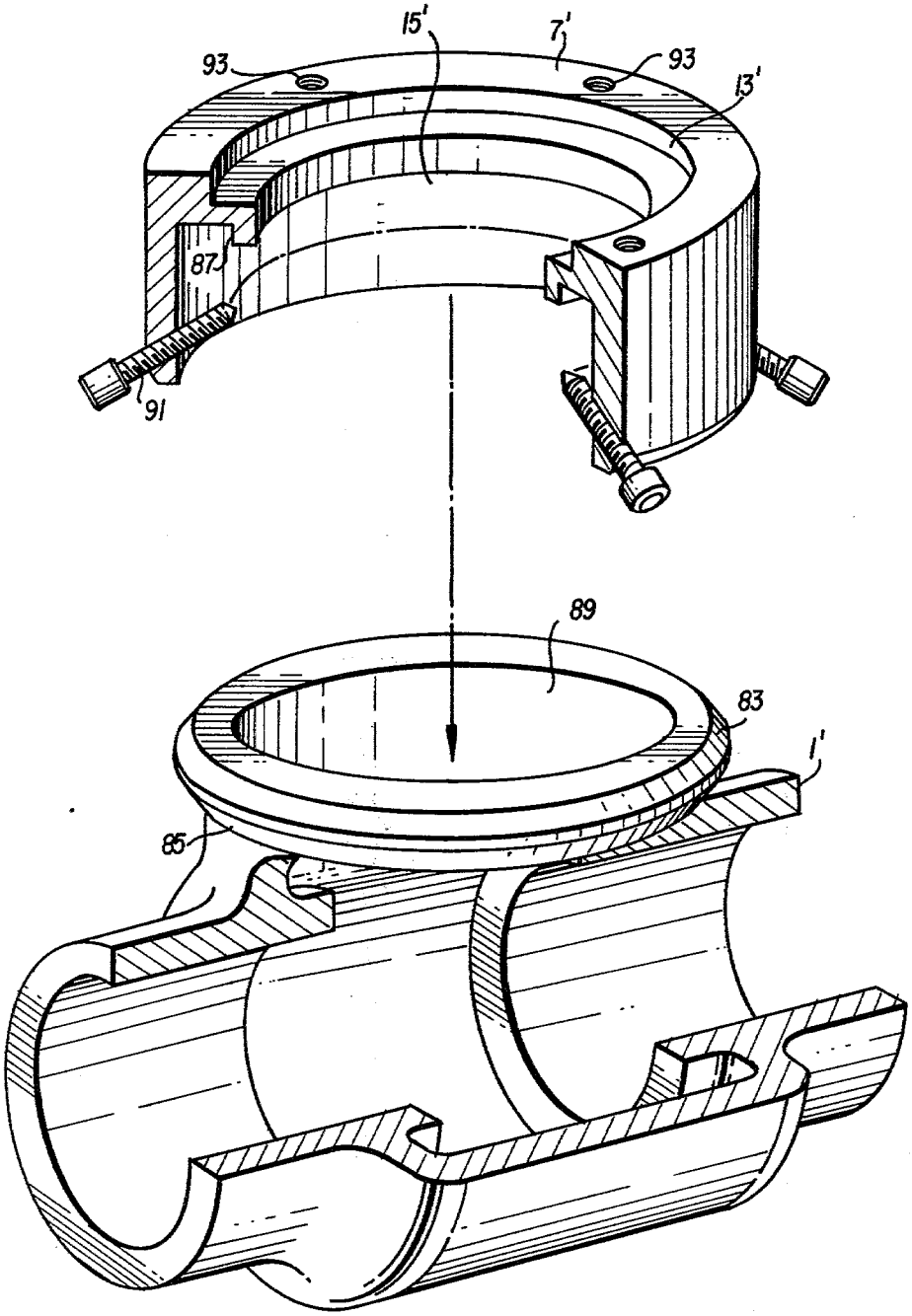

FIG. 6 shows an alternative embodiment of the adapter member suitable for use on valves of the type which are neither internally nor externally threaded but instead have a lip extending around the periphery of the top portion of the valve body. As shown in FIG. 6, the valve body 1' has a top portion with a lip 83 extending around the periphery of the top portion. The lip 83 has a frusto-conical surface 85 facing generally downwardly and outwardly from the top portion of the valve body.

The adapter member 7' is provided with a downwardly depending lip 87 which is circular in configuration and which fits snugly within the opening 89 of the valve body when the adapter member is positioned thereon. The adapter member is provided with a plurality of threaded holes into which screws 91 may be inserted. The holes are all arranged such that when the adapter member 7' is placed on the valve body 1', the screws are directed generally perpendicular to the surface 85.

The adapter member 7' is provided with a circular recess 13' for receiving a base plate as with the previous embodiment. In addition, adapter member 7' is provided with a plurality of threaded holes 93 for receiving clamping screws like the screws 19 of FIG. 1. As in the previously described embodiments, the recess 13' should snugly receive a base plate while still permitting manual rotational movement of the base plate within the recess.

The adapter member 7' is placed on top of the valve body 1' with the depending leg 87 within the opening 89. Since the outer circumference of the leg 87 is only slightly smaller than the opening 89, this fixes the position of the adapter member relative to the valve body and prevents translational movement of the adapter member in a plane parallel to the top surface of the valve body. Thus, unskilled users of the tool need not worry about translational positioning of the adapter member in a plane parallel to the top surface of the valve since the lip 87 inherently positions the adapter member 7' so that its central opening 15' is concentrically located with respect to the opening 89 in the valve. Furthermore, the tightening of screws 91 against the surface 85 will not effect the translational positioning of the adapter member.

After the adapter member 7' is located on top of the valve body, the tool including the base plate is mounted on the adapter member as described for the preceding embodiments.

While a preferred embodiment of the invention has been described in specific detail, it will be understood by those skilled in the art and others that various modifications and substitutions may be made in the preferred embodiment without departing from the spirit and scope of the invention as defined by the appended claims.

I claim:

1. An adapter means for a gate valve reseating tool of the type utilized in refinishing the opposing seating surfaces of a high pressure gate valve after the operating components of the valve have been removed from the body thereof, said valve body having a top portion of generally circular configuration, said adapter means comprising:

an adapter member for mounting on the top portion of said valve body, said adapter member being configured to closely engage at least one surface of said top portion to positively locate said adapter member relative to said valve body and prevent translational movement between said adapter member and said top portion of said valve body in a predetermined plane during operation of said tool;

said adapter member having a generally planar top surface with a recess therein, and an opening extending from the bottom of said recess to the bottom extent of said adapter member through which the reseating tool extends, said predetermined plane being parallel to said top surface;

said recess being generally circular in shape and having a peripheral wall concentrically located with respect to said generally circular top portion of said valve body;

a base plate having an opening therein, said base plate being generally circular in shape so as to be snugly received in said recess, while permitting manual rotational movement of said base plate relative to said adapter member;

means mounted on said base plate for pivotally supporting said tool about an axis extending parallel to said base plate with said tool extending through said opening into said valve body; and, means for clamping said base plate to said adapter member in said recess to prevent relative rotational movement after said manual rotational positioning has been completed, to hold said base plate fixed during operation of said tool.

2. An adapter means as claimed in claim 1 wherein said adapter member is threaded to engage with threads on said top portion of said valve body.

3. An adapter means as claimed in claim 2 wherein said adapter member is internally threaded.

4. An adapter means as claimed in claim 1 wherein said top portion of said valve body is internally threaded and said adapter member is configured to threadingly engage the threads on said top portion.

5. An adapter means as claimed in claim 1 wherein said adapter member has a downwardly depending leg of circular configuration for snugly fitting within a circular opening in the top portion of said valve body, said top portion of said valve body having a lip extending around its periphery, and said adapter member having a plurality of threaded openings into which screws may be inserted to press against said lip and secure said adapter member to said top portion.

6. An adapter means as claimed in claim 5 wherein said lip has a frusto-conical surface facing downwardly and outwardly from said top portion, said threaded openings extending through said adapter member perpendicular to said frusto-conical surface.

* * * * *